United States Patent [19]

Vollmar

[11] 4,224,893

[45] Sep. 30, 1980

[54] WEED GUARD FOR ELECTRIC TROLLING MOTORS

[76] Inventor: Andy F. Vollmar, Box 42, Bokeelia, Fla. 33922

[21] Appl. No.: 897,701

[22] Filed: Apr. 19, 1978

[51] Int. Cl.[2] ..... B63H 1/14

[52] U.S. Cl. ..... 440/73; 440/6

[58] Field of Search ..... 115/40, 42, 17, 18 E, 115/70

[56] References Cited

U.S. PATENT DOCUMENTS

| | | | |
|---|---|---|---|
| 3,025,825 | 3/1962 | Martinson | 115/42 |
| 3,859,953 | 1/1975 | Todt | 115/42 |
| 4,013,033 | 3/1977 | Porter et al. | 115/42 |

*Primary Examiner*—Trygve M. Blix
*Assistant Examiner*—Frank Atwood
*Attorney, Agent, or Firm*—Alfred E. Wilson

[57] ABSTRACT

A weed guard for electric trolling motors including a generally semi-cylindrical lower portion to embrace the bottom portion of the electric motor and a forwardly upwardly angle portion from the lower portion, terminating at a point somewhat above the normal water line.

1 Claim, 2 Drawing Figures

WEED GUARD FOR ELECTRIC TROLLING MOTORS

BACKGROUND OF THE PRESENT INVENTION

A variety of forms of weed guards for outboard motors have been heretofore provided, some of which have been specifically designed for use in conjunction with electric trolling motors.

One such device is disclosed in U.S. Pat. No. 4,013,033 to Stephen G. Porter and Theodore J. Adams. This patent is directed to a structure which provides a band clamped to the motor housing rearwardly of the support shaft from the motor housing to the boat. A Circular skeletal frame extends outwardly and rearwardly from the band to catch the weeds as they approach the propeller area. This device because of the many openings therein, provided by the skeletal frame, would appear to be very likely to collect and hold onto most of the weeds, etc. that engage it. The structure itself would add a substantial amount of drag and with a collection of weeds, etc. thereon, a relatively low powered electric trolling motor could become quite incapacitated.

U.S. Pat. No. 3,859,953 to Dean S. Todt discloses a plurality of spaced apart, rearwardly outwardly angled wires or rods fixed to a band, clamped in place forwardly of the support shaft and in a surrounding relation to the propeller. While this device would not appear as apt to collect weeds, etc. as the aforementioned patents, its openness would appear to permit some weeds, etc. to pass through to the propeller.

The weed guard of the present invention is designed to deflect weeds, moss, lily pads, etc. away from the motor and propeller. It provides means to be clamped to the electric motor housing with a forwardly upwardly angled portion extending above the normal water line. Very frequently, water growths engage around the connection rod and, under the influence of the forward motion of the boat, will follow the rod downwardly to the motor and propeller.

It is therefore, one of the principal objects of the present invention to provide a guard for an electric trolling motor which extends from a point above the normal water line, rearwardly and downwardly to deflect all or most of the common and bothersome types of water growth downwardly under the motor housing and propeller.

A further object of the invention is to provide a weed guard for an electric trolling motor which is readily attachable to various makes and models of motors of this type, is simple and inexpensive to produce, is easy to install, durable and trouble free in operation.

DETAILED DESCRIPTION OF A PREFERRED EMBODIMENT

Figure 1:
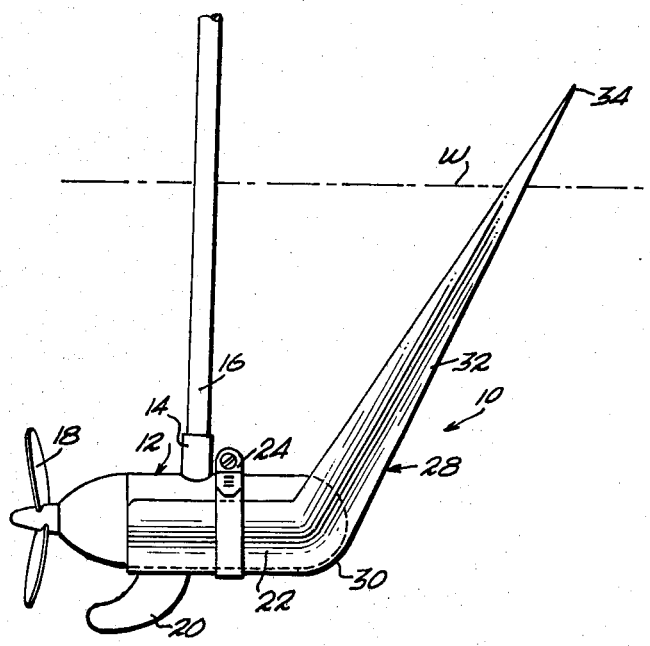
FIG. 1 is a side elevational view of the weed guard for electric trolling motors of the present invention, in a fixed relation to such a motor.

With reference to the drawings in which like reference characters designate like or corresponding parts throughout the views and with particular reference to FIG. 1, the weed guard, indicated generally at 10, is illustrated as attached to an electric motor housing 12. Motor housing 12 is fixed at 14 to a connecting rod 16 for attachment in a conventional manner to a boat (not shown), and a propeller 18 is operated by a conventional electric motor in housing 12. A skeg 20 extends downwardly from the bottom of housing 12.

A semi-cylindrical portion 22 of the weed guard wraps around the lower portion of the electric motor housing 12 which is conventionally tubular in form and at least one stainless steel hose clamp 24 is tightened around the portion 22 and the motor housing 12 to secure the weed guard in place.

Figure 2:
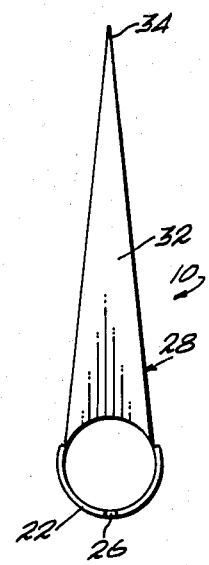
FIG. 2 is a rear elevational view of the weed guard removed from the motor.

As illustrated in FIG. 2, a slot 26 extends inwardly from the rear edge of the semi-cylindrical portion 22 to provide clearance for the skeg 20. A weed deflector arm 28, turns upwardly and forwardly at 30 in an angular relation to portion 22, the main length 32 of which terminates at 34 above the normal water line W when in use.

As illustrated, the main length 32 may be in the form of an elongated cone, terminating in an above water point 34. It can therefore be seen, that water growths of all types, weeds, moss, lily pads, etc., contacted by the main length portion 32 from water level W to the bottom of the motor housing 12 will either be deflected outwardly to one side thereof or around the bottom of motor housing 12 instead of being fed by the connecting rod 16 directly to the motor housing and propeller.

The weed guard may be formed of any appropriate high impact plastic material or from sheet metal.

I claim:

1. A weed guard for an electric trolling motor comprising, a first weed guard portion of semi-cylindrical shape to nest over the bottom portion of a conventional cylindrical housing of an electric trolling motor having a propeller, a second weed guard portion integral with the first weed guard portion extending angularly forwardly and upwardly from the housing of the trolling motor and being of such a length as to extend somewhat above the normal water line of the trolling motor when in use, the second portion of the weed guard being in the form of an elongated semi-cylindrical cone of the approximate diameter of the housing of the electric trolling motor at its base and extending to an apex somewhat above the normal water line of the trolling motor, the exterior of said second portion being smooth and unperforated to deflect weeds away from the propeller of the electric trolling motor.

* * * * *